US009523949B1

(12) United States Patent
Kikuchi

(10) Patent No.: US 9,523,949 B1
(45) Date of Patent: Dec. 20, 2016

(54) IMAGE FORMING APPARATUS THAT CONTROLS AN IMAGE FORMING SECTION AND A FIXING DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kazuhiko Kikuchi, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/729,220

(22) Filed: Jun. 3, 2015

(51) Int. Cl.
*G03G 15/20* (2006.01)

(52) U.S. Cl.
CPC ..... *G03G 15/2039* (2013.01)

(58) Field of Classification Search
CPC ..... G03G 15/2032; G03G 2215/2035; G03G 2215/2038; G03G 15/2039
See application file for complete search history.

(56) References Cited

U.S. PATENT DOCUMENTS 7,010,255 B2 * 3/2006 Yura ..... G03G 15/2017 399/328
7,039,332 B2 * 5/2006 Suzuki ..... G03G 15/2064 219/216
7,139,496 B1 * 11/2006 Roof ..... G03G 15/20 399/323
7,783,242 B2 * 8/2010 Chigono ..... G03G 15/6573 399/322
8,447,221 B2 * 5/2013 Hasegawa ..... G03G 15/2017 399/329
2004/0081491 A1 * 4/2004 Uchida ..... G03G 15/2039 399/328
2005/0036809 A1 * 2/2005 Fukita ..... G03G 15/206 399/328
2005/0191071 A1 * 9/2005 Katayanagi ..... G03G 15/206 399/45
2006/0029444 A1 * 2/2006 Naito ..... G03G 15/2064 399/329
2006/0239703 A1 * 10/2006 Kwon ..... G03G 15/2064 399/45
2007/0047989 A1 * 3/2007 Nakamura ..... G03G 15/2039 399/67
2008/0107436 A1 * 5/2008 Mikutsu ..... G03G 15/206 399/67
2008/0181662 A1 * 7/2008 Lee ..... G03G 15/2032 399/126

(Continued)

*Primary Examiner* — David Bolduc
(74) *Attorney, Agent, or Firm* — Amin, Turocy & Watson LLP; Gregory Turocy

(57) ABSTRACT

A fixing device includes a fixing belt, a nip pad, a press roller, a driving portion, and a heat generation source. The fixing belt has an endless shape. The nip pad is located on an inner circumferential side of the fixing belt. The nip pad presses the fixing belt. The press roller presses the fixing belt along with the nip pad. The driving portion moves the press roller toward the nip pad. The heat generation source causes the fixing belt to generate heat. A control section controls an image forming section and the fixing device. The nip pad includes a protrusion. The protrusion protrudes toward an outer circumference of the fixing belt and a downstream side of the nip. The control section changes a movement amount of a protrusion to the press roller.

9 Claims, 8 Drawing Sheets

(56) References Cited

U.S. PATENT DOCUMENTS

2008/0205948 A1* 8/2008 Baba ..... G03G 15/2007 399/329
2009/0324266 A1* 12/2009 Kobayashi ..... G03G 15/2042 399/45
2010/0046995 A1* 2/2010 Nakamura ..... G03G 15/2032 399/328
2010/0092220 A1* 4/2010 Hasegawa ..... G03G 15/2064 399/328
2010/0092221 A1* 4/2010 Shinshi ..... G03G 15/2039 399/330
2010/0158553 A1* 6/2010 Ueno ..... G03G 15/2064 399/67
2010/0172677 A1* 7/2010 Hosokawa ..... G03G 15/2064 399/329
2010/0202809 A1* 8/2010 Shinshi ..... G03G 15/2064 399/329
2010/0290822 A1* 11/2010 Hasegawa ..... G03G 15/2064 399/329
2011/0026987 A1* 2/2011 Hasegawa ..... G03G 15/2053 399/329
2011/0052277 A1* 3/2011 Ueno ..... G03G 15/2064 399/328
2011/0222874 A1* 9/2011 Yamada ..... G03G 15/2085 399/33
2011/0222875 A1* 9/2011 Imada ..... G03G 15/205 399/33
2011/0222881 A1* 9/2011 Yamada ..... G03G 15/2032 399/45
2011/0229178 A1* 9/2011 Ogawa ..... G03G 15/6576 399/67
2011/0229201 A1* 9/2011 Yamada ..... G03G 15/2028 399/122
2011/0293339 A1* 12/2011 Yoshikawa ..... G03G 15/206 399/329
2011/0305473 A1* 12/2011 Tamaki ..... G03G 15/2053 399/67
2012/0027444 A1* 2/2012 Kitagawa ..... G03G 15/2032 399/69
2012/0027477 A1* 2/2012 Nakayama ..... G03G 15/2064 399/328
2012/0114345 A1* 5/2012 Fujimoto ..... G03G 15/2017 399/44
2012/0141174 A1* 6/2012 Kurita ..... G03G 15/161 399/329
2012/0224895 A1* 9/2012 Baba ..... G03G 15/2007 399/329
2012/0308278 A1* 12/2012 Kikuchi ..... H05B 6/145 399/329
2013/0084088 A1* 4/2013 Sakai ..... G03G 15/2064 399/45
2013/0251422 A1* 9/2013 Iwaya ..... G03G 15/2053 399/329
2013/0279957 A1* 10/2013 Kasama ..... G03G 15/2085 399/329
2013/0330111 A1* 12/2013 Tokuda ..... G03G 15/6576 399/329
2015/0104227 A1* 4/2015 Shimokawa ..... G03G 15/2053 399/329

* cited by examiner

IMAGE FORMING APPARATUS THAT CONTROLS AN IMAGE FORMING SECTION AND A FIXING DEVICE

FIELD

Embodiments described herein relate generally to an image forming apparatus.

BACKGROUND

In recent years, there are image forming apparatuses such as a multi-function peripheral (hereinafter, referred to as an "MFP") and a printer. The image forming apparatus includes a fixing device. The fixing device heats a conductive layer of a fixing belt by using an electromagnetic induction heating method (hereinafter, referred to as an "IH" method). The fixing device fixes a toner image to a recording medium with heat of the fixing belt. For example, the fixing device includes a press roller on an outer circumferential side of the endless fixing belt. The fixing device includes a nip pad on an inner circumferential side of the fixing belt. The nip pad opposes the press roller with the fixing belt interposed therebetween. The fixing device causes a sheet (recording medium) to pass through a nip between the fixing belt and the press roller. Hereinafter, likeliness of a sheet peeling off from the fixing belt is referred to as a "peeling property". In the fixing device, in order to improve the peeling property, the load on a downstream side in a sheet transport direction within the nip is increased. In the fixing device, even if the load on the downstream side of the nip in the sheet transport direction is increased, there is a possibility that the peeling property may deteriorate depending on the type of sheet and margin setting of the sheet.

DETAILED DESCRIPTION

Figure 1:
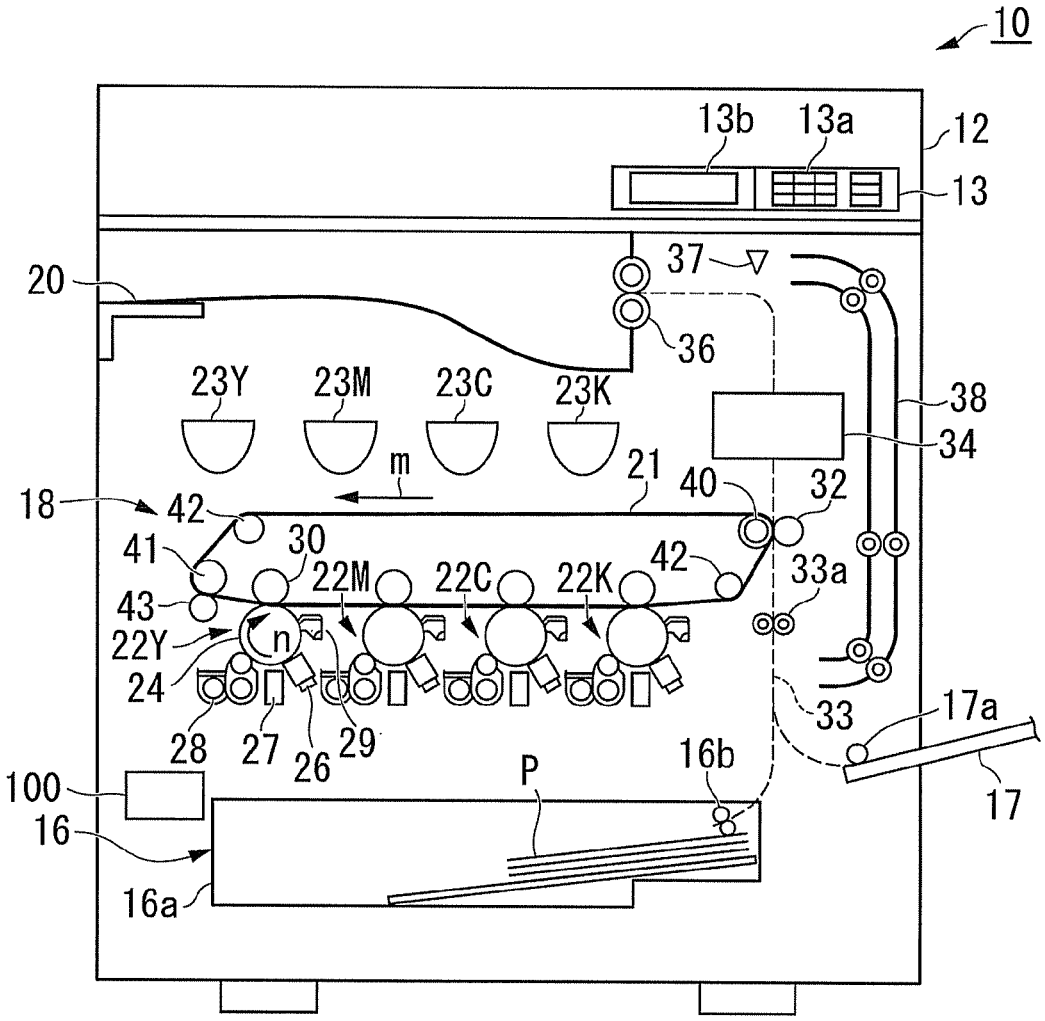
FIG. 1 is a side view of an image forming apparatus according to an exemplary embodiment.

An image forming apparatus of an exemplary embodiment includes an input section, an imaging forming section, a fixing device, and a control section. The input section allows information regarding a recording medium to be input. The image forming section forms an image on the recording medium. The fixing device includes a fixing belt, a nip pad, a press roller, a driving portion, and a heat generation source. The fixing belt has an endless shape. The nip pad is located on an inner circumferential side of the fixing belt. The nip pad presses the fixing belt. The press roller is located on an outer circumferential side of the fixing belt. The press roller presses the fixing belt along with the nip pad. The press roller forms a nip. The driving portion moves the press roller toward the nip pad. The heat generation source causes the fixing belt to generate heat. The control section controls the image forming section and the fixing device. The nip pad includes a protrusion. The protrusion protrudes toward an outer circumference of the fixing belt and a downstream side of the nip. The control section controls the driving portion on the basis of the information regarding the recording medium input by the input section. The control section changes a movement amount of a protrusion to the press roller.

Hereinafter, an image forming apparatus 10 of an exemplary embodiment will be described with reference to the drawings. In the respective drawings, the same constituent elements are given the same reference numeral.

FIG. 1 is a side view of the image forming apparatus 10 according to the exemplary embodiment. Hereinafter, an MFP 10 will be described as an example of the image forming apparatus 10.

As illustrated in FIG. 1, the MFP 10 includes a scanner 12, a control panel 13, a paper feeding cassette unit 16, a paper feeding tray 17, a printer unit 18, and a paper discharge unit 20. The MFP 10 includes a CPU 100 which controls the entire MFP 10. The CPU 100 controls a main body control circuit 101 (refer to FIG. 2).

The scanner 12 reads an original document image. The control panel 13 includes an input key 13*a* and a display portion 13*b*. For example, the input key 13*a* receives an input operation from a user. For example, the display portion 13*b* is of a touch panel type. The display portion 13*b* receives an input operation from the user and performs corresponding display to the user.

The paper feeding cassette unit 16 includes a paper feeding cassette 16*a* and pickup rollers 16*b*. The paper feeding cassette 16*a* stores a sheet P which is a recording medium. The pickup rollers 16*b* extract the sheet P from the paper feeding cassette 16*a*.

The paper feeding cassette 16*a* feeds an unused sheet P. The paper feeding tray 17 feeds an unused sheet P with a pickup roller 17*a*.

The printer unit 18 forms an image of the original document image read by the scanner 12. The printer unit 18 includes an intermediate transfer belt 21. The printer unit 18 supports the intermediate transfer belt 21 with a backup roller 40, a driven roller 41, and a tension roller 42. The backup roller 40 includes a driving portion (not illustrated). The printer unit 18 rotates the intermediate transfer belt 21 in a direction of an arrow m.

The printer unit 18 includes four sets of image forming stations 22Y, 22M, 22C and 22K. The image forming stations 22Y, 22M, 22C and 22K are used to respectively form yellow (Y), magenta (M), cyan (C) and black (K) images. The image forming stations 22Y, 22M, 22C and 22K are disposed in parallel in the rotation direction of the intermediate transfer belt 21 below. the intermediate transfer belt 21.

The printer unit 18 includes cartridges 23Y, 23M, 23C and 23K over the image forming stations 22Y, 22M, 22C and 22K. The cartridges 23Y, 23M, 23C and 23K respectively store yellow (Y), magenta (N), cyan (C) and black (K) toner particles to be supplied.

Hereinafter, among the image forming stations 22Y, 22M, 22C and 22K, the yellow (Y) image forming station 22Y will be described later as an example. The image forming stations 22M, 22C and 22K have the same configurations as a configuration of the image forming station 22Y, and thus detailed description thereof will be omitted.

The image forming station 22Y includes an electrostatic charger 26, an exposure scanning head 27, a developing device 28, and a photoconductor cleaner 29. The electrostatic charger 26, the exposure scanning head 27, the developing device 28, and the photoconductor cleaner 29 are disposed around a photoconductive drum 24 which is rotated in an arrow n direction.

The image forming station 22Y includes a primary transfer roller 30. The primary transfer roller 30 opposes the photoconductive drum 24 with the intermediate transfer belt 21 interposed therebetween.

In the image forming station 22Y, the photoconductive drum 24 is charged by the electrostatic charger 26 and is then exposed to light by the exposure scanning head 27. The image forming station 22Y forms an electrostatic latent image on the photoconductive drum 24. The developing device 28 develops the electrostatic latent image on the photoconductive drum 24 by using a developer containing two components including toner and carriers.

The primary transfer roller 30 primarily transfers a toner image formed on the photoconductive drum 24 onto the intermediate transfer belt 21. The image forming stations 22Y, 22M, 22C and 22K form a color toner image on the intermediate transfer belt 21 by using the primary transfer roller 30. The color toner image is formed by sequentially overlapping yellow (Y), magenta (M), cyan (C) and black (K) toner images on each other. The photoconductor cleaner 29 removes toner remaining on the photoconductive drum 24 after the primary transfer.

The printer unit 18 includes a secondary transfer roller 32. The secondary transfer roller 32 opposes the backup roller with the intermediate transfer belt 21 interposed therebetween. The secondary transfer roller 32 secondarily transfers the color toner image on the intermediate transfer belt 21 onto the sheet P. The sheet P is fed from the paper feeding cassette unit 16 or the manual paper feeding tray 17 along a transport path 33.

The printer unit 18 includes a belt cleaner 43 which opposes the driven roller 41 via the intermediate transfer belt 21. The belt cleaner 43 removes toner remaining on the intermediate transfer belt 21 after the secondary transfer. In addition, an image forming portion includes the intermediate transfer belt 21, the four sets of image forming stations (22Y, 22M, 22C and 22K), and the secondary transfer roller 32.

The printer unit 18 includes resist rollers 33*a*, a fixing device 34 (a fixing device), and paper discharge rollers 36 along the transport path 33. The printer unit 18 includes a branching portion 37 and a reverse transport portion 38 on the downstream side of the fixing device 34. The branching portion 37 forwards the sheet P after undergoing fixation to the paper discharge unit 20 or the reverse transport portion 38. In a case of duplex printing, the reverse transport portion 38 reverses and transports the sheet P which is sent from the branching portion 37, in the direction of the resist rollers 33*a*. The MFP 10 forms a fixed toner image on the sheet P in the printer unit 18. The MFP 10 discharges the sheet P on which the fixed toner image is formed to the paper discharge unit 20.

The sheet P is transported to the paper discharge unit 20 from the paper feeding cassette unit 16 or the manual paper feeding tray 17 (hereinafter, referred to as a "paper feeding portion") along the transport path 33. Hereinafter, the paper feeding portion side is set as an upstream side with respect to the sheet transport direction. Hereinafter, the paper discharge unit 20 side is set as a downstream side with respect to the sheet transport direction.

The MFP 10 is not limited to a tandem developing method. In the MFP 10, the number of developing device 28 is not limited thereto either. The MFP 10 may direct transfer a toner image onto the sheet P from the photoconductive drum 24.

Hereinafter, the fixing device 34 will be described in detail.

Figure 2:
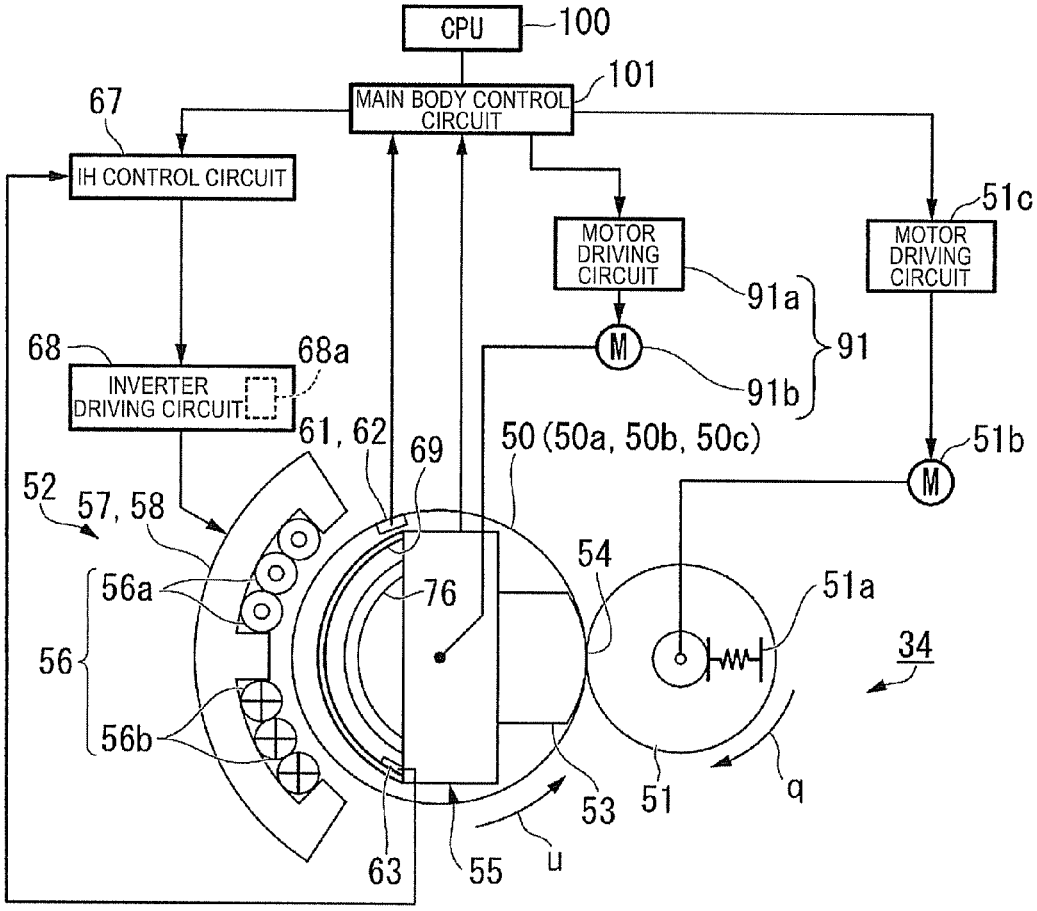
FIG. 2 is a side view of a fixing device including a control block of an IH coil unit.

FIG. 2 is a side view of the fixing device 34 including a control block of an electromagnetic induction heating coil unit 52 according to the exemplary embodiment. The electromagnetic induction heating coil unit is referred to as an "IH coil unit".

As illustrated in FIG. 2, the fixing device 34 includes a fixing belt 50, the IH coil unit 52, and an auxiliary heat generation plate 69.

The fixing belt 50 is a tubular endless belt. An internal belt mechanism 55 which supports a nip pad 53 and the auxiliary heat generation plate 69 is disposed on an inner circumferential side of the fixing belt 50.

The fixing belt 50 is rotated in an arrow u direction by following a press roller 51. Alternatively, the fixing belt 50 may be rotated in the arrow u direction separately from the press roller 51. If the fixing belt 50 and the press roller 51 are rotated separately from each other, a one-way clutch may be provided so that a speed difference between the fixing belt 50 and the press roller 51 is not generated.

In the fixing belt 50, a heat generation layer 50*a* (conductive layer) which is a heat generation portion and a release layer 50*c* are sequentially laminated on a base layer 50*b*. In addition, a layer structure of the fixing belt 50 is not limited thereto as long as the fixing belt 50 includes the heat generation layer 50*a*.

For example, the base layer 50*b* is made of a polyimide resin (PI). For example, the heat generation layer 50*a* is made of a nonmagnetic metal such as copper (Cu). For example, the release layer 50*c* is made of a fluororesin such as a tetrafluoroethylene-perfluoroalkyl vinyl ether copolymer resin (PFA).

In the fixing belt 50, in order to realize rapid warming-up, the heat generation layer 50*a* is thinned so as to reduce the heat capacity. The fixing belt 50 having the small heat capacity reduces the time required in warming-up. Energy consumption is reduced by reducing the time required in the warming-up.

For example, in the fixing belt 50, a thickness of the copper layer of the heat generation layer 50*a* is 10 μm in order to reduce the heat capacity. For example, the heat generation layer 50*a* is covered by a protective layer such as nickel. The protective layer such as nickel prevents oxidation of the copper layer. The protective layer such as nickel improves mechanical strength of the copper layer.

The heat generation layer 50*a* may be formed on the base layer 50*b* made of a polyimide resin through electroless nickel plating and copper plating. Through the electroless nickel plating, adhesion strength between the base layer 50*b* and the heat generation layer 50*a* is improved. Through the electroless nickel plating, mechanical strength of the heat generation layer 50*a* is improved.

A surface of the base layer 50*b* may be roughened through sand blasting or chemical etching. Since the surface of the base layer 50*b* is roughened, adhesion strength between the base layer 50*b* and the plated nickel of the heat generation layer 50*a* is further mechanically improved.

A metal such as titanium (Ti) may be dispersed into the polyimide resin forming the base layer 50*b*. If a metal is dispersed into the base layer 50*b*, adhesion strength between the base layer 50*b* and the plated nickel of the heat generation layer 50*a* is further improved.

The heat generation layer 50*a* may be made of, for example, nickel, iron (Fe), stainless steel, aluminum (Al), and silver (Ag). The heat generation layer 50*a* may employ two or more kinds of alloys, and may employ two or more kinds of layered metals which overlap each other.

In the heat generation layer 50*a*, an eddy current is generated by magnetic flux which is generated by the IH coil unit 52. The heat generation layer 50*a* generates Joule heat by using the eddy current and electric resistance of the heat generation layer 50*a* so as to heat the fixing belt 50.

Figure 3:
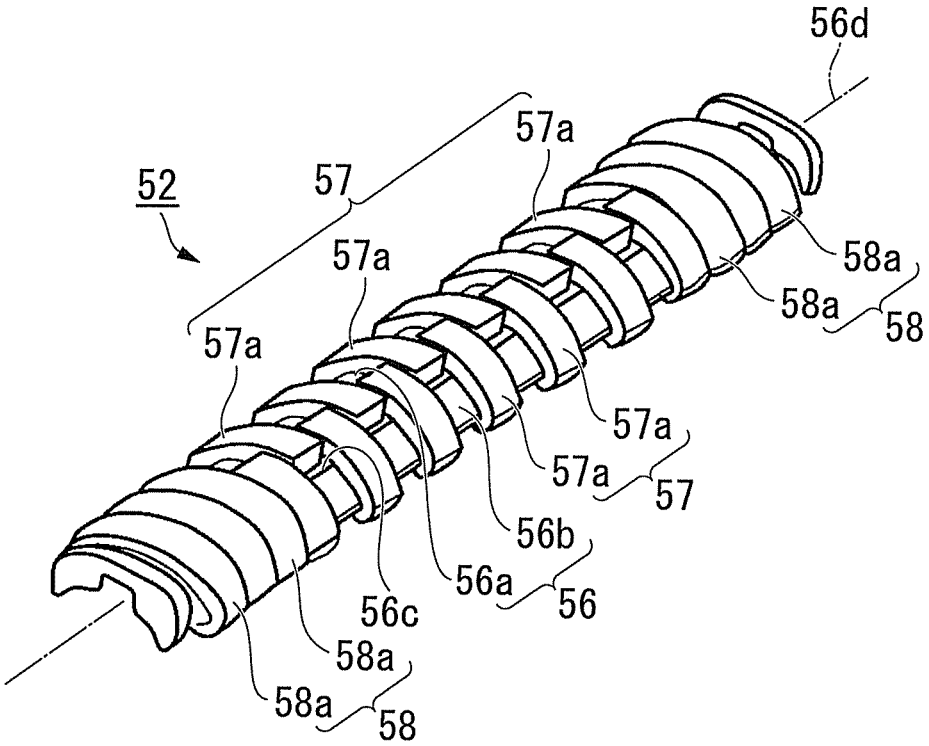
FIG. 3 is a perspective view of the IH coil unit.

FIG. 3 is a perspective view of the IH coil unit 52 according to the exemplary embodiment.

As illustrated in FIG. 3, the IH coil unit 52 includes a coil 56, a first core 57, and second cores 58.

The coil 56 generates magnetic flux when a high frequency current is applied thereto. The coil 56 opposes the fixing belt 50 in a thickness direction. A longitudinal direction of the coil 56 matches a width direction (hereinafter, referred to as a "belt width direction") of the fixing belt 50.

The first core 57 and the second cores 58 cover an opposite side (hereinafter, referred to as a "rear surface side") of the coil 56 to the fixing belt 50. The first core 57 and the second cores 58 prevent the magnetic flux generated by the coil 56 from leaking out of the rear surface side. The first core 57 and the second cores 58 cause the magnetic flux from the coil 56 to concentrate on the fixing belt 50.

The first core 57 includes a plurality of one-wing portions 57*a*. The plurality of one-wing portions 57*a* are alternately disposed in a zigzag form so as to form axial symmetry with respect to a central line 56*d* lying in the longitudinal direction of the coil 56.

The second cores 58 are disposed on both sides of the first core 57 in the longitudinal direction. Each of the second cores 58 includes a plurality of two-wing portions 58*a* which extend over both wings of the coil 56.

For example, the one-wing portions 57*a* and the two-wing portions 58*a* are made of magnetic materials such as a nickel-zinc alloy (Ni—Zn) and a manganese-nickel alloy (Mn—Ni).

In the first core 57, the plurality of one-wing portions 57*a* restrict the magnetic flux generated by the coil 56. The magnetic flux generated by the coil 56 is alternately restricted every other one-wings of the coil 56 so as to form axial symmetry with respect to the central line 56*d*. In the first core 57, the plurality of one-wing portions 57*a* cause the magnetic flux from the coil 56 to concentrate on the fixing belt 50.

In the second cores 58, the plurality of two-wing portions 58*a* restrict the magnetic flux generated by the coil 56. The magnetic flux generated by the coil 56 is restricted by both of the wings of the coil 56 on both sides of the first core 57. In the second cores 58, the plurality of two-wing portions 58*a* cause the magnetic flux from the coil 56 to concentrate on the fixing belt 50. The magnetic flux concentration power of the second cores 58 is greater than the magnetic flux concentration power of the first core 57.

The coil 56 includes a first wing 56*a* and a second wing 56*b*. The first wing 56*a* is disposed on one side with respect to the central line 56*d*. The second wing 56*b* is disposed on the other side with respect to the central line 56*d*. A window portion 56*c* is formed between the first wing 56*a* and the second wing 56*b* and on an inner side of the coil 56 in the longitudinal direction.

As illustrated in FIG. 2, the IH coil unit 52 generates an inducted current while the fixing belt 50 is rotated in the arrow u direction. The heat generation layer 50*a* of the fixing belt 50 opposing the IH coil unit 52 generates heat due to the induced current. The IH coil unit 52 corresponds to a heat generation source which causes the heat generation layer 50*a* of the fixing belt 50 to generate heat.

For example, a litz wire is used as the coil 56. The litz wire is formed by bundling a plurality of copper wires coated with heat-resistive polyamide-imide which is an insulating material. The coil 56 is formed by winding a conductive coil.

The coil 56 generates magnetic flux when a high frequency current is applied thereto by an inverter driving circuit 68. For example, the inverter driving circuit 68 includes an insulated gate bipolar transistor (IGBT) element 68*a*.

The auxiliary heat generation plate 69 has an arc shape disposed in a circumferential direction of the fixing belt 50 when viewed from the belt width direction. The auxiliary heat generation plate 69 opposes the first wing 56*a* and the second wing 56*b* of the coil 56 via the fixing belt 50. The auxiliary heat generation plate 69 causes an eddy current due to the magnetic flux generated by the IH coil unit 52 so as to generate heat. The auxiliary heat generation plate 69 assists the IH coil unit 52 with heat generation from the heat generation layer 50*a* of the fixing belt 50. The auxiliary heat generation plate 69 assists heating of the fixing belt 50. The auxiliary heat generation plate 69 is disposed in a region surrounded by the fixing belt 50.

The auxiliary heat generation plate 69 is supported by a shield 76 on an opposite side to the coil 56. The shield 76 has the same arc shape as the auxiliary heat generation plate 69 when viewed from the belt width direction. The shield 76 is disposed on an inner circumferential side of the auxiliary heat generation plate 69. For example, the shield 76 is made of a nonmagnetic material such as aluminum or copper. The shield 76 shields, the magnetic flux from the IH coil unit 52. The shield 76 prevents the magnetic flux from influencing the nip pad 53 or the like.

The auxiliary heat generation plate 69 is made of a magnetic shunt alloy. The magnetic shunt alloy which is an alloy of iron and nickel has a Curie point of 220° C. to 230° C. The magnetic shunt alloy is a thin metal member. If the Curie point is exceeded, the auxiliary heat generation plate 69 has a weakened magnetic force, and thus heating assistance of the fixing belt 50 is weakened. Since the auxiliary heat generation plate 69 is made of the magnetic shunt alloy, the fixing belt 50 is heated within a range of heat resistance temperatures.

The auxiliary heat generation plate 69 may be made of a thin metal member having a magnetic characteristic, such as iron, nickel, and stainless steel. In addition, the auxiliary heat generation plate 69 may be made of a resin containing magnetic powder as long as the resin has a magnetic characteristic. The auxiliary heat generation plate 69 may be made of the following magnetic material (ferrite). The magnetic material (ferrite) promotes heat generation of the fixing belt 50 with magnetic flux caused by an eddy current. The magnetic material (ferrite) does not generate heat even if receiving the magnetic flux caused by the eddy current. The auxiliary heat generation plate 69 is not limited to a thin plate member.

The auxiliary heat generation plate 69 may be provided with a plurality of slits perpendicular to a direction of a current induced by the IH coil unit 52. If the auxiliary heat generation plate 69 is provided with the plurality of slits, an eddy current generated in the auxiliary heat generation plate 69 is divided thereby. In other words, the eddy current generated in the auxiliary heat generation plate 69 becomes an eddy occurring between the slits. Since the auxiliary heat generation plate 69 is provided with the plurality of slits, a size of an eddy occurring between the slits can be reduced more than if the auxiliary heat generation plate 69 is not provided with the plurality of slits. As a result of the size of the eddy occurring between the slits being reduced, heat generation of the auxiliary heat generation plate 69 can be reduced.

Both ends of the auxiliary heat generation plate 69 are supported by the internal belt mechanism 55 in the circumferential direction of the fixing belt 50. For example, the first end of the auxiliary heat generation plate 69 is supported via a swing shaft 69*a* (refer to FIG. 6) disposed in the belt width direction. The second end of the auxiliary heat generation plate 69 is supported via a biasing member 69*b* (refer to FIG. 6) such as a spring. The auxiliary heat generation plate 69 is biased toward the inner circumferential surface of the fixing belt 50.

The auxiliary heat generation plate 69 may be biased toward the fixing belt 50 without swinging. The auxiliary heat generation plate 69 may be controlled to approach and separate from the fixing belt 50. For example, the auxiliary heat generation plate 69 may separate from the fixing belt 50 before warming up the fixing device 34. The auxiliary heat generation plate 69 may approach the fixing belt 50 after warming up the fixing device 34.

The auxiliary heat generation plate 69 may be disposed with a minute gap with respect to the fixing belt 50.

Figure 4:
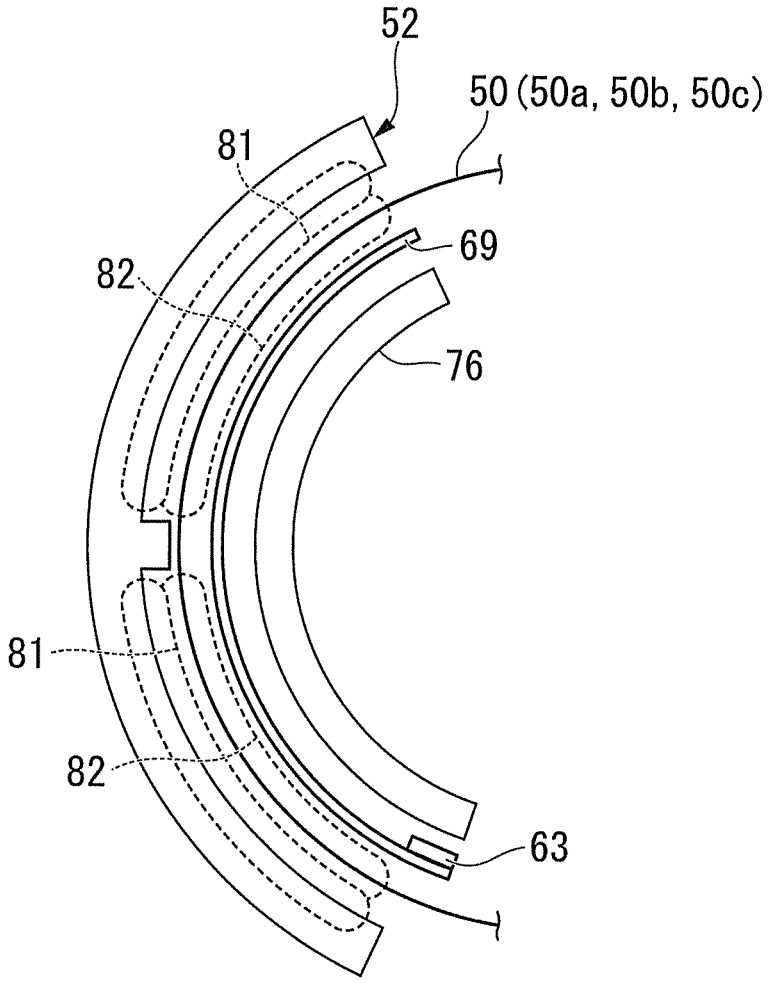
FIG. 4 is a diagram illustrating magnetic paths directed to a fixing belt and an auxiliary heat generation plate by magnetic flux from the IH coil unit.

FIG. 4 is a diagram illustrating magnetic paths directed to the fixing belt 50 and the auxiliary heat generation plate 69 by magnetic flux from the IH coil unit 52 according to the exemplary embodiment. In FIG. 4, for convenience, the coil 56 and the like are not illustrated. In FIG. 4, for convenience, the fixing belt 50 and the auxiliary heat generation plate 69 separate from each other.

As illustrated in FIG. 4, magnetic flux generated by the IH coil unit 52 forms a first magnetic path 81 induced in the heat generation layer 50*a* of the fixing belt 50. The magnetic flux generated by the IH coil unit 52 forms a second magnetic path 82 induced in the auxiliary heat generation plate 69.

The auxiliary heat generation plate 69 generates heat due to the magnetic flux generated by the IH coil unit 52. The auxiliary heat generation plate 69 assists the heat generation layer 50*a* of the fixing belt 50 in generating heat during warming-up of the fixing belt 50 so as to accelerate the warming-up. The auxiliary heat generation plate 69 assists the heat generation layer 50*a* of the fixing belt 50 in generating heat during printing. A fixation temperature is maintained by assisting the heat generation layer 50*a* of the fixing belt 50 in generating heat.

As illustrated in FIG. 2, the nip pad 53 is a pressing portion which presses the inner circumferential surface of the fixing belt 50 toward the press roller 51 side. A nip 54 is formed between the fixing belt 50 and the press roller 51.

For example, the nip pad 53 is made of an elastic material such as silicon rubber or a fluororubber. The nip pad 53 may be made of a heat resistive resin such as a polyimide resin (PI), a polyphenylene sulfide resin (PPS), a polyether sulfone resin (PES), liquid crystal polymer (LCP), or phenol resin (PF).

The press roller 51 is located on the outer circumferential side of the fixing belt 50. The press roller 51 includes an elastic layer 51*g* (refer to FIGS. 8 and 9) such as a heat resistive silicon sponge or a silicon rubber layer around its core. For example, a release layer is disposed on a surface of the press roller 51. The release layer is made of a fluororesin such as a PFA resin. The press roller 51 presses the fixing belt 50 with a pressing mechanism 51*a*. The press roller 51 is a pressing portion which presses the fixing belt 50 along with the nip pad 53. The press roller 51 presses the fixing belt 50 along with the nip pad 53 so as to form the nip 54. The press roller 51 is rotated in an arrow q direction by a motor 51*b*. The motor 51*b* is driven by a motor driving circuit 51*c* which is controlled by the main body control circuit 101.

A center thermistor 61, an edge thermistor 62, and a thermostat 63 are disposed in a region surrounded by the fixing belt 50.

The center thermistor 61 and the edge thermistor 62 detect a temperature of the fixing belt 50. The center thermistor 61 and the edge thermistor 62 output a detection result of the temperature of the fixing belt 50 to the main body control circuit 101. The center thermistor 61 is disposed at a center of the fixing belt 50 in the belt width direction.

The edge thermistor 62 is disposed further outward than the IH coil unit 52 in the belt width direction. The edge thermistor 62 detects a temperature of an outer part of the fixing belt 50 in the belt width direction with high accuracy without being influenced by the IH coil unit 52.

The main body control circuit 101 controls an IH control circuit 67 according to detection results from the center thermistor 61 and the edge thermistor 62. The IH control circuit 67 controls a high frequency current output from the inverter driving circuit 68 under the control of the main body control circuit 101. The fixing belt 50 is maintained in various control temperature ranges in accordance with an output from the inverter driving circuit 68.

The thermostat 63 functions as a safety device of the fixing device 34. The thermostat 63 operates if the fixing belt 50 abnormally generates heat and thus a temperature thereof increases to a cut-off threshold value. If the thermostat 63 operates, a current does not flow to the IH coil unit 52. The MFP 10 stops its operation if a current does not flow to the IH coil unit 52. The MFP 10 stops its operation and thus abnormal heat generation from the fixing device 34 is prevented.

Hereinafter, main portions of the fixing device 34 according to the exemplary embodiment will be described with reference to FIGS. 6 and 7.

Figure 6:
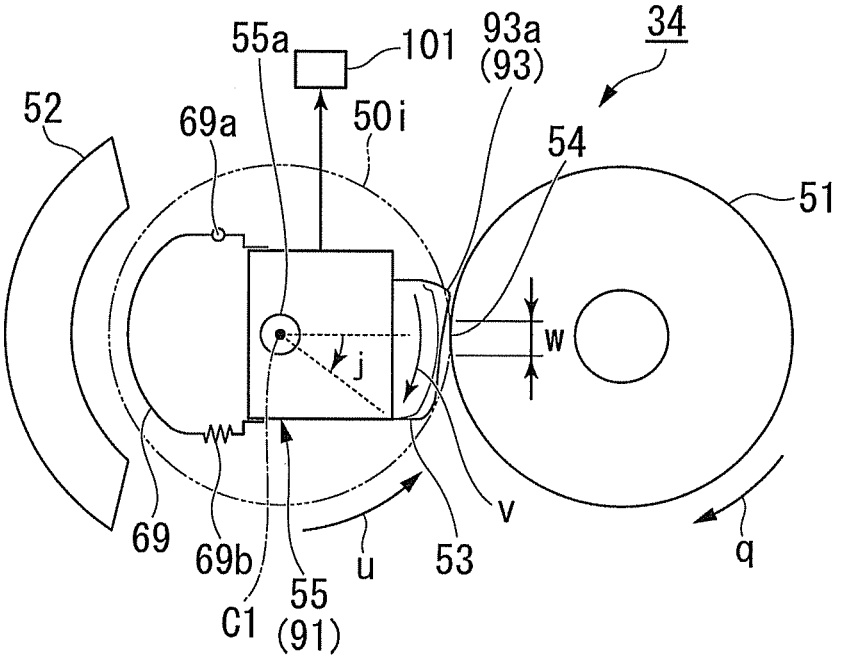
FIG. 6 is a side view of the fixing device.

FIG. 6 is a side view of the fixing device 34 according to the exemplary embodiment. FIG. 7 is an enlarged view of main portions of the fixing device 34 according to the exemplary embodiment. For convenience, in FIGS. 6 and 7, a reference trajectory 50*i* on design formed by the fixing belt 50 is indicated by a two-dot chain line. The reference trajectory 50*i* forms an annular shape when viewed from the belt width direction.

Figure 7:
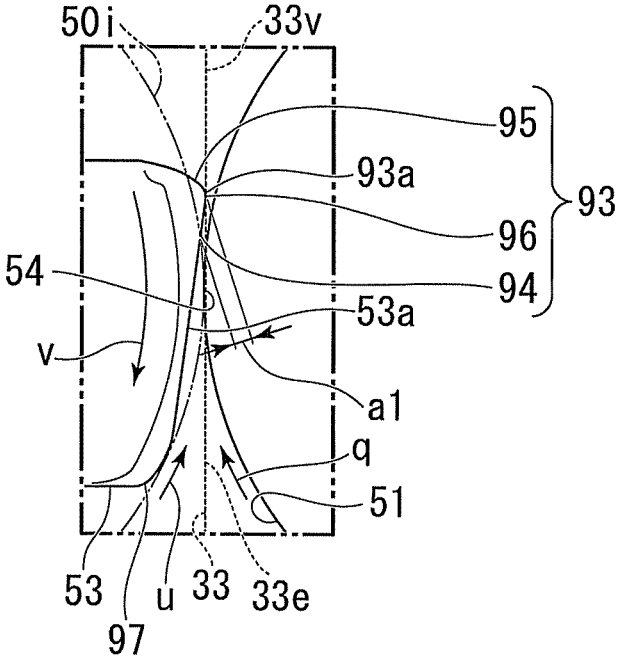
FIG. 7 is an enlarged view of main portions.

As illustrated in FIGS. 6 and 7, the fixing device 34 includes the nip pad 53, the press roller 51, a driving portion 91, and the main body control circuit 101 (control section). The sheet P passes through the nip 54 between the fixing belt 50 and the press roller 51, along the transport path 33.

The driving portion 91 includes the internal belt mechanism 55, and the pressing mechanism 51*a*, motor driving circuits 51*c* and 91*a*, and the motors 51*b* and 91*b* illustrated in FIG. 2. The internal belt mechanism 55 has a shaft 55*a* which is parallel to the belt width direction. The shaft 55*a* has the same axis as an axis of a center C1 of the reference trajectory 50*i*. The internal belt mechanism 55 supports the nip pad 53. The motor 91*b* is driven by the motor driving circuit 91*a* (refer to FIG. 2) which is controlled by the main body control circuit 101. The internal belt mechanism 55 is rotated centering on the shaft 55*a* in an arrow v direction by the motor 91*b*. The internal belt mechanism 55 is rotated along with the nip pad 53. The nip pad 53 is rotated centering on the same axis as the axis of the center C1 of the reference trajectory 50*i*. The pressing mechanism 51*a* (driving portion) moves the press roller 51 toward the nip pad 53. The nip pad 53 is moved in a rotation direction centering on the shaft 55*a* with respect to the press roller 51. The nip pad 53 may approach and separate from the press roller 51.

The nip pad 53 has a nip forming surface 53*a* for forming the nip 54 between the fixing belt 50 and the press roller 51. The nip forming surface 53*a* is curved so as to form a protrusion on the inner circumferential side of the fixing belt 50 when viewed from the width direction of the fixing belt 50. The nip forming surface 53*a* is curved so as to be disposed along the outer circumferential surface of the press roller 51 when viewed from the width direction of the fixing belt 50. A curvature of the nip forming surface 53*a* is smaller than a curvature of the outer circumferential surface of the press roller 51.

The nip pad 53 includes a protrusion 93 which is located further toward the downstream side in the rotation direction (traveling direction) u of the fixing belt 50 than the nip forming surface 53*a*. The protrusion 93 is located on an outlet 33*v* side of the sheet P which passes between the fixing belt 50 and the press roller 51 in the nip pad 53. The protrusion 93 protrudes toward the outer circumference and the downstream side of the fixing belt 50.

Figure 8:
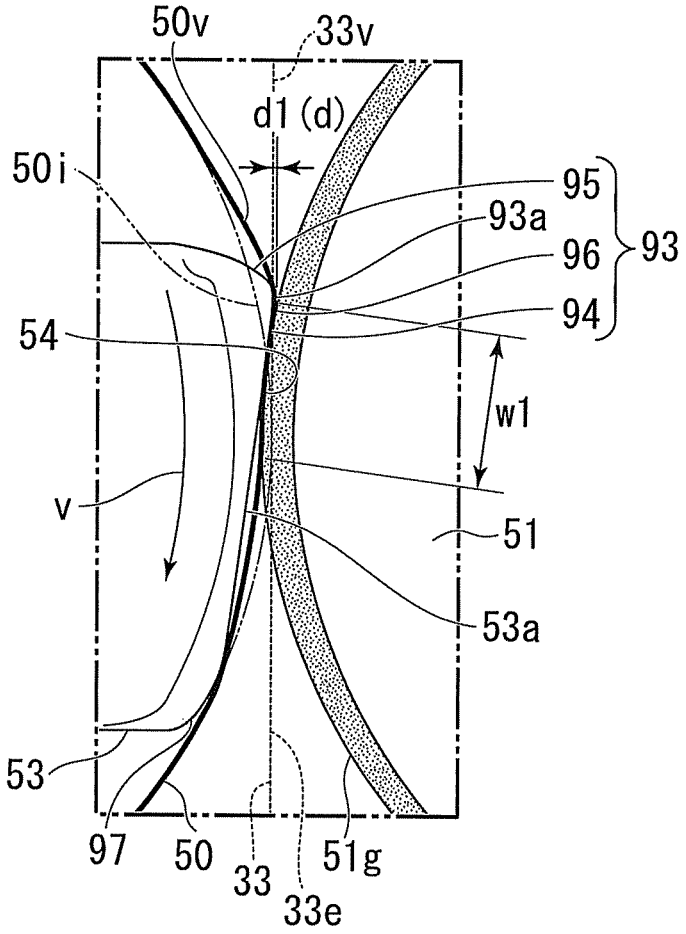
FIG. 8 is a side view illustrating a state in which a nip pad is located at a reference position.

Since the protrusion 93 protrudes toward the outer circumference and the downstream side of the fixing belt 50, the traveling trajectory of the fixing belt 50 is deformed with respect to the reference trajectory 50*i* (refer to FIG. 8). For convenience, in FIGS. 6 and 7, the deformed trajectory of the fixing belt 50 is not illustrated.

As illustrated in FIG. 7, the protrusion 93 has a first face 94, a second face 95, and a third face 96. The first face 94 is located toward the upstream side in the rotation direction u of the fixing belt 50 than a protruding end 93*a*. The first face 94 is tilted so as to be located on the outer circumferential side of the fixing belt 50 by the downstream side in the rotation direction u of the fixing belt 50 when viewed from the width direction of the fixing belt 50.

The second face 95 is located further toward the downstream side in the rotation direction u of the fixing belt 50 than the protruding end 93*a*. The second face 95 is tilted so as to be located on the inner circumferential side of the fixing belt 50 by the downstream side in the rotation direction u of the fixing belt 50 when viewed from the width direction of the fixing belt 50.

The third face 96 is located between the first face 94 and the second face 95. The third face 96 connects the first face 94 to the second face 95. The third face 96 is curved so as to form a protrusion on the outer circumferential side of the fixing belt 50 when viewed from the width direction of the fixing belt 50. The third face 96 includes the protruding end 93*a*.

The nip pad 53 includes a curved portion 97 which is located further toward the upstream side in the rotation direction u of the fixing belt 50 than the nip forming surface 53*a*. The curved portion 97 is located on an inlet 33*e* of the sheet P which passes between the fixing belt 50 and the press roller 51 in the nip pad 53. The curved portion 97 is smoothly curved so as to form a protrusion toward the outer circumference of the fixing belt 50 and the upstream side of the nip 54. The curved portion 97 comes into contact with the inner circumferential surface of the fixing belt 50.

Figure 9:
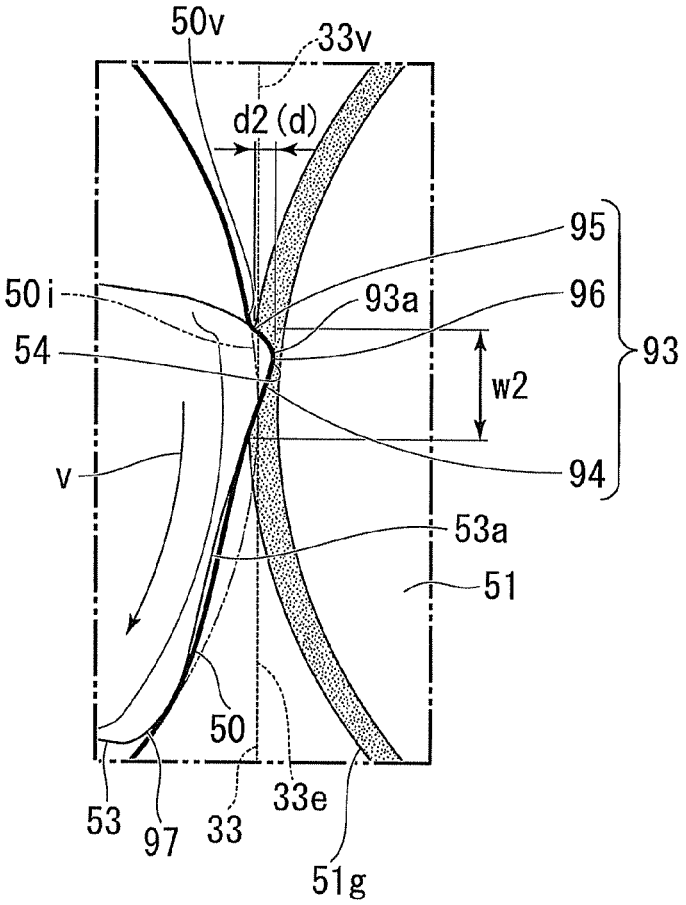
FIG. 9 is a side view illustrating a state in which the nip pad is located at a rotation position.
Figure 10:
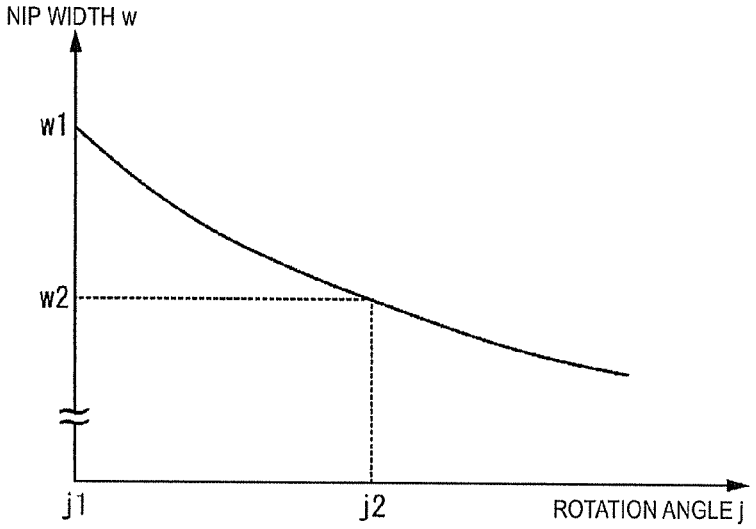
FIG. 10 is a graph illustrating a relationship between a rotation angle and a nip width of the nip pad.

FIG. 8 is a side view illustrating a state in which the nip pad 53 according to the exemplary embodiment is located at a reference position. FIG. 9 is a side view illustrating a state in which the nip pad 53 according to the exemplary embodiment is located at a rotation position. FIG. 10 is a graph illustrating a relationship between a rotation angle and a nip width of the nip pad 53 according to the exemplary embodiment.

Here, the "rotation angle" indicates an angle j (refer to FIG. 6) with which the nip pad 53 is rotated in the arrow v direction centering on the shaft 55*a*. The "nip width" indicates a length w (refer to FIG. 6) of a portion where the fixing belt 50 comes into contact with the press roller 51 in the sheet transport direction.

Hereinafter, a description will be made of a relationship between the rotation angle and the nip width with reference to FIG. 10.

In FIG. 10, a rotation angle j1 is a rotation reference of the nip pad 53. The rotation angle j1 is an angle at the reference position of the nip pad 53. For example, the rotation angle j1 is 0°. A rotation angle j2 is an angle at a rotation position of the nip pad 53 which is rotated in the arrow v direction with respect to the rotation reference. The rotation angle j2 is greater than the rotation angle j1 (j2>j1). A nip width w1 is a reference of the nip width. The nip width w1 is a length at the reference position of the nip pad 53. The nip width w1 is a nip width at the rotation angle j1. A nip width w2 is a nip width at the rotation angle j2. The nip width w2 is smaller than the nip width w1 (w2<w1).

As illustrated in FIG. 10, the nip width gradually and smoothly decreases as the rotation angle increases.

Hereinafter, a ratio of a decrease amount to the nip width w1 is referred to as a "nip decrease ratio". A nip decrease ratio Z (%) is calculated according to the following Equation (1).

$$Z=\{1-(w2/w1)\}\times 100 \quad (1)$$

For example, a nip width obtained when a nip decrease ratio for the nip width w1 is about 10% is set as the nip width w2.

The motor driving circuit 91*a* (refer to FIG. 2) changes an amount of the protruding end 93*a* (protrusion) to be moved to the press roller 51 on the basis of information regarding the sheet P, input by an input section. The information regarding the sheet P includes the type of sheet P and margin setting of the sheet P. Specifically, the type of sheet P includes a thickness of the sheet P. The margin setting of the sheet P includes a margin length of the sheet P.

The information regarding the sheet P is input by a user on the control panel 13 (refer to FIG. 1). In addition, the information regarding the sheet P may be read by the scanner 12 (refer to FIG. 1), a sensor (not illustrated), and the like. The sensor is disposed in the middle of the transport path 33. The sensor detects a distal end (downstream end) and a trailing end (upstream end) of the sheet P, and a thickness of the sheet P. The sensor specifies the type of the sheet P on the basis of a detection result of the sheet P. The control panel 13, the scanner 12, and the sensor correspond to the input section which inputs information regarding the sheet P.

Hereinafter, a distance a1 from the reference trajectory 50*i* to the protruding end 93*a* of the protrusion 93 is referred to as a "protruding amount of the protrusion". Specifically, a protruding amount a1 of the protrusion 93 indicates a distance from the inner circumferential surface of the fixing belt which is not deformed to the protruding end 93*a* of the protrusion 93. The main body control circuit 101 controls the protruding amount a1 of the protrusion 93. The driving portion 91 maintains the protruding amount a1 of the protrusion 93 under the control of the main body control circuit 101. The driving portion 91 causes the protrusion 93 to approach the press roller 51 while making the protruding amount a1 constant. In addition, the driving portion 91 may change the protruding amount a1. Since the press roller 51 has the elastic layer 51*g* around its core, if the protrusion 93 approaches the press roller 51, the protrusion 93 bites into the elastic layer 51*g*.

Hereinafter, a biting amount of the protrusion 93 into the press roller 51 is referred to as a "biting amount". Here, the outer circumferential surface of the press roller 51 before the protrusion 93 bites into the press roller 51 is referred to as a "reference surface". A position of the protruding end 93*a* after the protrusion 93 bites into the press roller 51 is referred to as a "biting position". A biting amount d illustrated in FIGS. 8 and 9 is a distance from the reference surface to the biting position.

For example, as thickness information of the sheet P, a thick sheet, a normal sheet, and a thin sheet are set. For example, the thick sheet is a postcard which is about 0.25 mm thick. For example, the normal sheet is copy paper which is about 0.09 mm thick. For example, the thin sheet is Japanese writing paper which is about 0.07 mm thick. Information regarding the sheet P such as the thick sheet, the normal sheet, and the thin sheet is input by the user on the control panel 13. The thickness (in a large thickness) of the thick sheet is used as a reference of a thickness of the sheet P. If a thickness of the sheet P to be used is smaller than the thickness reference of the sheet P (hereinafter, referred to as "in a small thickness"), the driving portion 91 increases a movement amount of the protruding end 93*a* to the press roller 51. In the small thickness, the driving portion 91 increases the biting amount d.

For example, as information regarding a margin length of the sheet P, information such as a large margin, an intermediate margin, and a small margin is set. The margin is assumed to be a margin of one end side of the sheet P in the sheet transport direction. For example, the large margin is a margin length which is about 10% of a sheet length in the sheet transport direction. For example, the intermediate margin is a margin length which is about 8% of a sheet length in the sheet transport direction. For example, the small margin is a margin length which is about 5% of a sheet length in the sheet transport direction. The information regarding the sheet P, such as the large margin, the intermediate margin, and, the small margin is input by the user on the control panel 13. The large margin (in a large margin) is used as a margin reference of the sheet P. If a margin length of the sheet P to be used is smaller than the margin reference of the sheet P (hereinafter, referred to as "in a small margin"), the driving portion 91 increases a movement amount of the protruding end 93*a* to the press roller 51. In the small margin, the driving portion 91 increases the biting amount d.

The driving portion 91 adjusts the biting amount d by changing the rotation angle j. In the small thickness, the biting amount d is increased by making a rotation angle greater than in the large thickness as the thickness reference. In the small margin, the biting amount d is increased by making a rotation angle greater than in the large margin as the margin reference.

Hereinafter, the reference position of the nip pad 53 will be described with reference to FIG. 8.

As illustrated in FIG. 8, the protrusion 93 is held at the reference position. The fixing belt 50 is locally deformed by the protrusion 93 on the outlet 33*v* side of the sheet P which passes between the fixing belt 50 and the press roller 51. A biting amount d1 at the reference position (hereinafter, referred to as a "reference biting amount") is made slightly larger than 0 (d1>0). Since the reference biting amount d1 is made slightly larger than 0, the load on the downstream side of the nip 54 in the sheet transport direction is slightly increased. The protrusion 93 maintains the protruding amount a1 (refer to FIG. 7).

Hereinafter, a description will be made of a state (hereinafter, referred to as "during rotation") in which a rotation angle is greater than at the reference position with reference to FIG. 9.

As illustrated in FIG. 9, the protrusion 93 is driven and is rotated in the arrow v direction by the driving portion 91. The fixing belt 50 is locally deformed by the protrusion 93 on the outlet 33*v* side of the sheet P which passes between the fixing belt 50 and the press roller 51. The nip pad 53 is stopped in a state in which the protrusion 93 bites into the elastic layer 51*g* of the press roller 51. A biting amount d2 during rotation is made larger than the reference biting amount d1 (d2>d1). Since the biting amount d2 is made larger than the reference biting amount d1, the load on the downstream side of the nip 54 in the sheet transport direction is increased more than at the reference position. The load on the downstream side of the nip 54 in the sheet transport direction is made larger than at the reference position, and thus a peeling property is improved more than at the reference position. Also during rotation, the protrusion 93 maintains the protruding amount a1 (refer to FIG. 7). The nip width w2 during rotation is smaller than the nip width w1 at the reference position (w2<w1).

An extent of local deformation of the fixing belt 50 during rotation becomes larger than at the reference position. Specifically, an outlet portion 50*v* of the fixing belt 50 which is located on the outlet 33*v* side of the sheet P is more rapidly tilted toward the protrusion 93 (the second face 95) than at the reference position. Since the outlet portion 50*v* of the fixing belt 50 is more rapidly tilted toward the protrusion 93 than at the reference position, a peeling property is improved more than at the reference position.

The biting amount d may be adjusted by using the small thickness and the small margin as a reference position. For example, when a thickness of the thick sheet is used as a thickness reference, if a thickness of the sheet P to be used is larger than the thickness reference of the sheet P, the biting amount d may be reduced. For example, when the small margin is used as a margin reference, if a margin length of the sheet P to be used is larger than the margin reference of the sheet P, the biting amount d may be reduced. Adjustment of the biting amount d may be changed depending on specification design of the fixing device 34.

Hereinafter, a detailed description will be made of a control system 110 of the IH coil unit 52 which causes the fixing belt 50 to generate heat.

Figure 5:
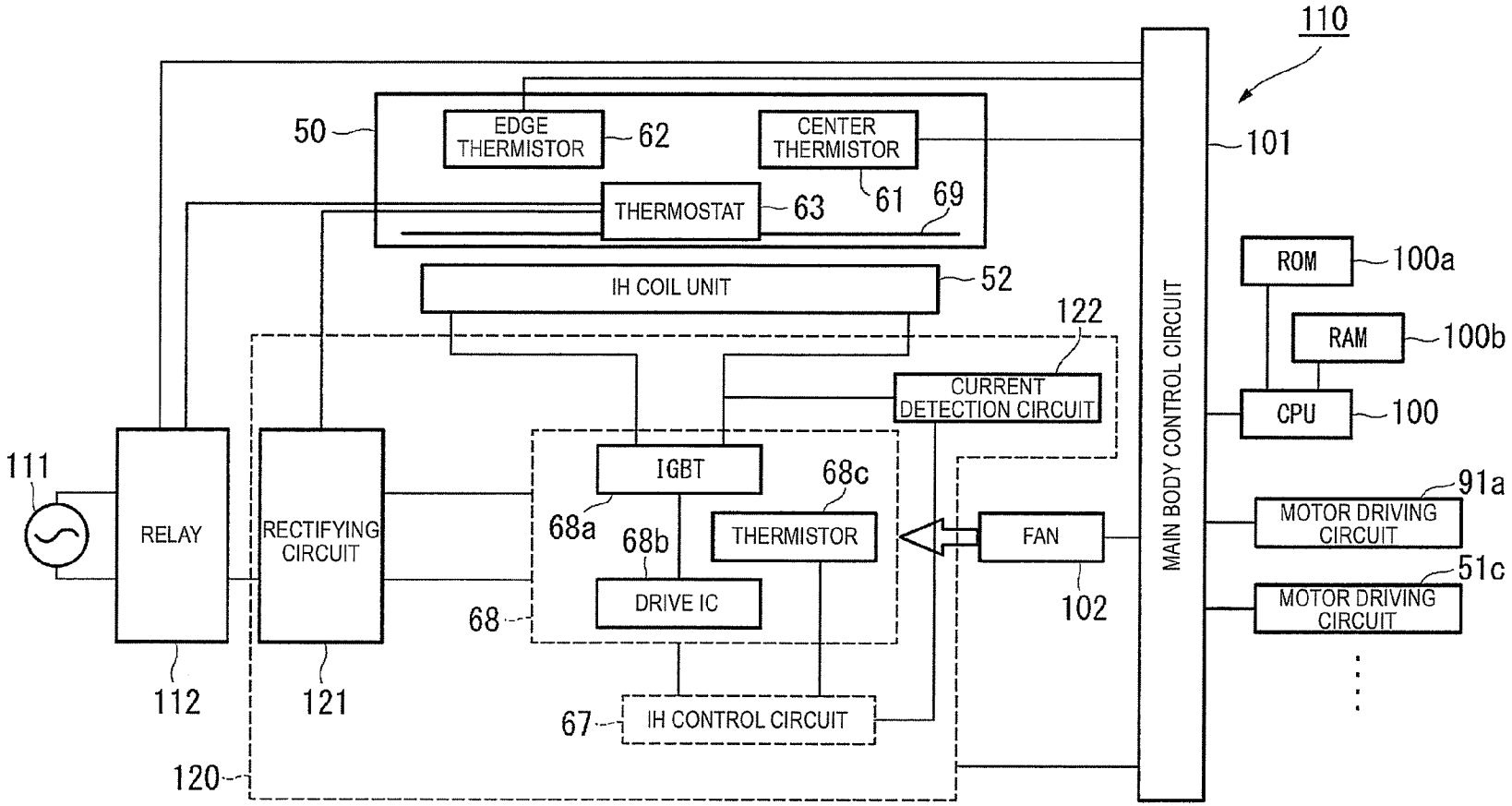
FIG. 5 is a block diagram illustrating a control system which mainly controls the IH coil unit.

FIG. 5 is a block diagram illustrating the control system 110 which mainly controls the IH coil unit 52 according to the exemplary embodiment.

As illustrated in FIG. 5, the control system 110 includes the CPU 100, a read only memory (ROM) 100*a*, a random access memory (RAM) 100*b*, the main body control circuit 101, an IH circuit 120, the motor driving circuit 51*c*, and the motor driving circuit 91*a*. In addition, the main body control circuit 101 may include the IH circuit 120, the motor driving circuit 51*c*, and the motor driving circuit 91*a*.

In the control system 110, the IH circuit 120 supplies power to the IH coil unit 52. The IH circuit 120 includes a rectifying circuit 121, the IH control circuit 67, the inverter driving circuit 68, and a current detection circuit 122.

A current is input to the IH circuit 120 from an AC power source 111 via a relay 112. The IH circuit 120 rectifies the input current with the rectifying circuit 121 so as to supply the rectified current to the inverter driving circuit 68. The relay 112 cuts off a current from the AC power source 111 if the thermostat 63 is stopped. The inverter driving circuit 68 includes the IGBT element 68*a*, a drive IC 68*b*, and a thermistor 68*c*. The thermistor 68*c* detects a temperature of the IGBT element 68*a*. If the thermistor 68*c* detects an increase in the temperature of the IGBT element 68*a*, the main body control circuit 101 drives a fan 102 so as to cool the IGBT element 68*a*.

The IH control circuit 67 controls the drive IC 68*b* on the basis of detection results from the center thermistor 61 and the edge thermistor 62. The IH control circuit 67 controls the drive IC 68*b* so as to control an output of the IGBT element 68*a*. The current detection circuit 122 sends a detection result of the output of the IGBT element 68*a* to the IH control circuit 67. The IH control circuit 67 controls the drive IC 68*b* so that constant power is supplied to the coil 56 on the basis of the detection result from the current detection circuit 122.

Hereinafter, a description will be made of an operation of the fixing device 34 during warming-up.

As illustrated in FIG. 2, during warming-up, the fixing device 34 rotates the press roller 51 in the arrow q direction so that the fixing belt 50 is driven-rotated in the arrow u direction. The IH coil unit 52 generates magnetic flux on the fixing belt 50 side when the inverter driving circuit 68 applies a high frequency current thereto.

As illustrated in FIG. 4, the magnetic flux from the IH coil unit 52 induces the first magnetic path 81 which passes through the heat generation layer 50*a* of the fixing belt 50 so that the heat generation layer 50*a* generates heat. The magnetic flux from the IH coil unit 52, penetrating through the fixing belt 50, induces the second magnetic path 82 which passes through the auxiliary heat generation plate 69 so that the auxiliary heat generation plate 69 generates heat. The second magnetic path 82 formed between the heat generation layer 50*a* and the auxiliary heat generation plate 69 assists heating of the heat generation layer 50*a*.

As illustrated in FIG. 2, the IH control circuit 67 controls the inverter driving circuit 68 on the basis of a detection result from the center thermistor 61 or the edge thermistor 62. The inverter driving circuit 68 supplies a high frequency current to the coil 56.

Hereinafter, a description will be made of an operation of the fixing device 34 during a fixing operation.

If there is a printing request after the fixing belt 50 reaches a fixing temperature and finishes warming-up, the MFP 10 (refer to FIG. 1) starts a printing operation. The MFP 10 forms a toner image on the sheet P in the printer unit 18 and transports the sheet P to the fixing device 34.

In the MFP 10, the sheet P on which the toner image is formed passes the nip 54 between the fixing belt 50 reaching the fixing temperature and the press roller 51. The fixing device 34 fixes the toner image to the sheet P. During the fixing, the IH control circuit 67 controls the IH coil unit 52 so that the fixing belt 50 is kept at the fixing temperature.

Due to the fixing operation, the heat of the fixing belt 50 is taken by the sheet P. For example, if sheets continuously pass at a high speed, heat is excessively taken by the sheet P, and thus the fixing belt 50 with low heat capacity may not be kept at the fixing temperature. The heating of the fixing belt 50 is assisted by the second magnetic path 82 formed between the heat generation layer 50*a* and the auxiliary heat generation plate 69, and thus deficiency of a belt heat generation amount is supplemented. Since the fixing belt 50 is heated by the second magnetic path 82, a temperature of the fixing belt 50 is maintained to be the fixing temperature even if sheets continuously pass at a high speed.

Meanwhile, in order to improve a peeling property in the fixing device 34, the load on the downstream side of the nip 54 in the sheet transport direction is increased. Even if the load on the downstream side of the nip 54 in the sheet transport direction is increased, there is a possibility that the peeling property may deteriorate in the fixing device 34 depending on the type of sheet P and margin setting of the sheet P. Particularly, in a case of a color printer, yellow (Y), magenta (N), cyan (C) and black (K) toner images sequentially overlap each other, and thus deterioration in the peeling property is notable. Specifically, if the sheet P is a thick sheet, the rigidity of the sheet P increases, and thus the sheet P easily peels off from the fixing belt 50. In addition, if a margin length of the sheet P is made large, a fixation area of the sheet P is reduced, and thus the sheet P easily peels off from the fixing belt 50.

On the other hand, if the sheet P is a thin sheet, the rigidity of the sheet P decreases, and thus the sheet P hardly peels off from the fixing belt 50. In addition, if a margin length of the sheet P is made small, a fixation area of the sheet P is increased, and thus the sheet P hardly peels off from the fixing belt 50.

For example, in order to improve the peeling property, the load on the downstream side of the nip 54 in the sheet transport direction may be increased. However, even if the load on the downstream side of the nip 54 in the sheet transport direction is increased, there is a possibility that the peeling property may deteriorate in the fixing device 34 depending on the type of sheet P and margin setting of the sheet P. In addition, if the load on the downstream side of the nip 54 in the sheet transport direction is increased, a nip width is reduced, and thus a trade-off relationship occurs as a result of deterioration in performance of a thick sheet.

Here, an example of the performance will be described. Hereinafter, an amount of heat for fixing a toner image onto the sheet P is referred to as a "fixing heat amount Q". Hereinafter, a temperature at which a toner image is fixed onto the sheet P is referred to as a "fixing temperature T". Hereinafter, time at which the sheet P passes through the nip 54 is referred to as "passing time N". The fixing heat amount Q is calculated by using the following Equation (2).

$$Q=T\times N \tag{2}$$

If the load on the downstream side of the nip 54 in the sheet transport direction is increased, a nip width is reduced. If the nip width is reduced, the fixing heat amount Q is hard to secure. Particularly, if the sheet P is a thick sheet, the fixing heat amount Q is harder to secure when the nip width is reduced than if the sheet P is a normal sheet and a thin sheet. In order to secure the fixing heat amount Q, the passing time N is required to be increased when the fixing temperature T is made constant. If the passing time N is increased, rotation speeds of the fixing belt 50 and the press roller 51 are required to be reduced. If the rotation speeds of the fixing belt 50 and the press roller 51 are reduced, fast continuous sheet passing is hard to perform. Therefore, the performance deteriorates.

According to the exemplary embodiment, the nip pad 53 includes the protrusion 93. The protrusion 93 protrudes toward the outer circumference of the fixing belt 50 and the downstream side of the nip 54. The main body control circuit 101 controls the biting amount d on the basis of information regarding the sheet P, input by the input section. Since the biting amount d is controlled on the basis of the information regarding the sheet P, the load on the downstream side of the nip 54 in the sheet transport direction can be set to the optimum magnitude according to the sheet P to be used. For example, if a peeling property deteriorates due to the sheet P to be used, the biting amount d is made larger than at the reference position. Since the biting amount d is made larger than at the reference position, the load on the downstream side of the nip 54 in the sheet transport direction is increased more than at the reference position. Since the load on the downstream side of the nip 54 in the sheet transport direction is increased more than at the reference position, the peeling property can be improved. Therefore, the trade-off and the peeling property can be improved.

The fixing belt 50 is locally deformed on the outlet 33*v* side of the sheet P by the protrusion 93. If the fixing belt 50 is locally deformed on the outlet 33*v* side of the sheet P, the sheet P can naturally peel off from the fixing belt 50.

The main body control circuit 101 controls the biting amount d on the basis of a thickness of the sheet P among information pieces regarding the sheet P. Since the biting amount d is controlled on the basis of a thickness of the sheet P, the load on the downstream side of the nip 54 in the sheet transport direction is set to the optimum magnitude according to the thickness of the sheet P to be used. Since the load on the downstream side of the nip 54 in the sheet transport direction is set to the optimum magnitude according to the thickness of the sheet P to be used, the peeling property can be improved for each thickness of the sheet P to be used. For example, if a large thickness is used as a thickness reference of the sheet P, the biting amount d is made larger in a small thickness than at the reference position. Since the biting amount d is made larger than at the reference position, the load on the downstream side of the nip 54 in the sheet transport direction is increased more than at the reference position. Since the load on the downstream side of the nip 54 in the sheet transport direction is increased, the peeling property can be improved in the small thickness.

The main body control circuit 101 controls the biting amount d on the basis of a margin length of the sheet P among information pieces regarding the sheet P. Since the biting amount d is controlled on the basis of a margin length of the sheet P, the load on the downstream side of the nip 54 in the sheet transport direction is set to the optimum magnitude according to the margin length of the sheet P to be used. Since the load on the downstream side of the nip 54 in the sheet transport direction is set to the optimum magnitude according to the margin length of the sheet P to be used, the peeling property can be improved for each margin length of the sheet P to be used. For example, if a large margin is used as a margin reference of the sheet P, the biting amount d is made larger in a small margin than at the reference position. Since the biting amount d is made larger than at the reference position, the load on the downstream side of the nip 54 in the sheet transport direction is increased more than at the reference position. Since the load on the downstream side of the nip 54 in the sheet transport direction is increased, the peeling property can be improved in the small margin.

The main body control circuit 101 controls the protruding amount a1 of the protrusion 93 from the reference trajectory 50*i* to the protruding end 93*a*. The driving portion 91 maintains the protruding amount a1 of the protrusion 93 under the control of the main body control circuit 101. Since the protruding amount a1 is maintained, the biting amount d is easily controlled. Therefore, the load on the downstream side of the nip 54 in the sheet transport direction is easily set to the optimum magnitude.

The protrusion 93 has the first face 94 and the second face 95. The first face 94 is located further toward the upstream side in the rotation direction u of the fixing belt 50 than the protruding end 93*a*. The first face 94 is tilted so as to be located on the outer circumferential side of the fixing belt 50 by the downstream side in the rotation direction u of the fixing belt 50 when viewed from the width direction of the fixing belt 50. The second face 95 is located further toward the downstream side in the rotation direction u of the fixing belt 50 than the protruding end 93*a*. The second face 95 is tilted so as to be located on the inner circumferential side of the fixing belt 50 by the downstream side in the rotation direction u of the fixing belt 50 when viewed from the width direction of the fixing belt 50. Since the protrusion 93 has the first face 94 and the second face 95, the protrusion 93 smoothly bites into the press roller 51. Since the protrusion 93 smoothly bites into the press roller 51, the biting amount d is easily controlled.

The third face 96 is located between the first face 94 and the second face 95. The third face 96 connects the first face 94 to the second face 95. The third face 96 is curved so as to form a protrusion on the outer circumferential side of the fixing belt 50 when viewed from the width direction of the fixing belt 50. Since the third face 96 is curved so as to form a protrusion on the outer circumferential side of the fixing belt 50, the protrusion 93 is prevented from excessively biting into the press roller 51.

The nip forming surface 53*a* is curved so as to form a protrusion on the inner circumferential side of the fixing belt 50 when viewed from the width direction of the fixing belt 50. Since the nip forming surface 53*a* is curved so as to form a protrusion on the inner circumferential side of the fixing belt 50, the nip 54 is easily formed.

The nip pad 53 is rotated centering on the same axis as the axis of the center C1 of the reference trajectory 50*i*. Since the nip pad 53 is rotated centering on the same axis as the axis of the center C1 of the reference trajectory 50*i*, the protruding amount a1 is easily maintained.

According to at least one exemplary embodiment described above, the nip pad 53 includes the protrusion 93. The protrusion 93 protrudes toward the outer circumference of the fixing belt 50 and the downstream side of the nip 54. The main body control circuit 101 controls the biting amount d on the basis of information regarding the sheet P, input by the input section. Since the biting amount d is controlled on the basis of the information regarding the sheet P, the load on the downstream side of the nip 54 in the sheet transport direction can be set to the optimum magnitude according to the sheet P to be used. For example, if a peeling property deteriorates due to the sheet P to be used, the biting amount d is made larger than at the reference position. Since the biting amount d is made larger than at the reference position, the load on the downstream side of the nip 54 in the sheet transport direction is increased more than at the reference position. Since the load on the downstream side of the nip 54 in the sheet transport direction is increased more than at the reference position, the peeling property can be improved. Therefore, the trade-off and the peeling property can be improved.

While certain embodiments have been described, these embodiments have been presented by way of example only, and are not intended to limit the scope of the inventions. Indeed, the novel embodiments described herein may be embodied in a variety of other forms: furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus comprising:

an input section that allows information regarding a recording medium to be input;

an image forming section that forms an image on the recording medium;

a fixing device that includes an endless fixing belt;

a nip pad that is located on an inner circumferential side of the fixing belt and presses the fixing belt;

a press roller that is located on an outer circumferential side of the fixing belt, and presses the fixing belt along with the nip pad so as to form a nip;

a driving portion that moves the press roller toward the nip pad; and a heat generation source that causes the fixing belt to generate heat; and a control section that controls the image forming section and the fixing device, the nip pad includes a protrusion that protrudes toward an outer circumference of the fixing belt and a downstream side of the nip, the control section controls the driving portion on the basis of the information regarding the recording medium input by the input section so as to change a movement amount of the protrusion to the press roller, the nip pad is moved centering on the same axis as an axis of a center of a reference trajectory, and the fixing belt forms the reference trajectory when viewed from a belt width direction of the fixing belt.

2. The apparatus according to claim 1, wherein the control section controls the movement amount on the basis of a thickness of the recording medium included in the information.

3. The apparatus according to claim 1, wherein the control section controls the movement amount on the basis of a margin length of the recording medium included in the information.

4. The apparatus according to claim 1, wherein the fixing belt forms the reference trajectory when viewed from a belt width direction of the fixing belt, and wherein the control section controls a protruding amount of the protrusion from the reference trajectory to a protruding end of the protrusion.

5. The apparatus according to claim 1, wherein the protrusion includes a first face that is located further toward a traveling direction upstream side of the fixing belt than a protruding end of the protrusion, and a second face that is located further toward a traveling direction downstream side of the fixing belt than the protruding end, and wherein the first face is tilted so as to be located on the outer circumferential side of the fixing belt by the traveling direction downstream side of the fixing belt when viewed from a belt width direction of the fixing belt, and wherein the second face is tilted so as to be located on the inner circumferential side of the fixing belt by the traveling direction downstream side of the fixing belt when viewed from the belt width direction.

6. The apparatus according to claim 5, wherein a third face which connects the first face to the second face is disposed between the first face and the second face, and wherein the third face is curved so as to form a protrusion on the outer circumferential side of the fixing belt when viewed from the belt width direction.

7. The apparatus according to claim 1, wherein the nip pad includes a nip forming surface that forms a nip between the fixing belt and the press roller, and wherein the nip forming surface is curved so as to form a protrusion on the inner circumferential side of the fixing belt when viewed from a belt width direction of the fixing belt.

8. The apparatus according to claim 1, wherein the nip pad includes a curved portion that is curved so as to form a protrusion toward the outer circumference and an upstream side of the fixing belt when viewed from a belt width direction of the fixing belt.

9. The apparatus according to claim 8, wherein the nip pad includes a nip forming surface that forms a nip between the fixing belt and the press roller, and wherein the curved portion is located further toward a traveling direction upstream side of the fixing belt than the nip forming surface.

* * * * *